US007164364B2

(12) United States Patent
Ares Losada

(10) Patent No.: US 7,164,364 B2
(45) Date of Patent: Jan. 16, 2007

(54) SWIMMING POOL SPOTLIGHT LIGHTING SYSTEM

(75) Inventor: Manel Ares Losada, Barcelona (ES)

(73) Assignee: Sacopa, S.A.U., Sant Jaume de Llierca (Girona) (ES)

( * ) Notice: Subject to any disclaimer, the term of this patent is extended or adjusted under 35 U.S.C. 154(b) by 22 days.

(21) Appl. No.: 10/655,794

(22) Filed: Sep. 5, 2003

(65) Prior Publication Data

US 2004/0100206 A1 May 27, 2004

(30) Foreign Application Priority Data

Sep. 6, 2002 (ES) ..... 200202036

(51) Int. Cl.
*H05B 41/16* (2006.01)

(52) U.S. Cl. ..... 340/825.65; 362/101; 362/233; 362/394; 340/825.69; 340/825.62; 340/825.72

(58) Field of Classification Search ..... 362/101, 362/276, 233, 292, 294, 297, 307, 312, 316, 362/362, 394; 315/292, 294, 297, 307, 312, 315/316, 362; 340/825.69, 825.72, 825.62, 340/14.66, 825.65; 375/295–315
See application file for complete search history.

(56) References Cited

U.S. PATENT DOCUMENTS 3,818,477 A * 6/1974 Odams ..... 342/396
3,875,518 A * 4/1975 Odams ..... 327/231
5,977,882 A * 11/1999 Moore ..... 340/825.72
6,120,262 A * 9/2000 McDonough et al. .... 417/424.1
6,528,954 B1 * 3/2003 Lys et al. ..... 315/291
6,567,009 B1 * 5/2003 Ohishi et al. ..... 340/815.45
2003/0151909 A1 * 8/2003 Sid ..... 362/85
2004/0037221 A1 * 2/2004 Aisa ..... 370/229

* cited by examiner

*Primary Examiner*—Sandra O'Shea
*Assistant Examiner*—Anabel Ton
(74) *Attorney, Agent, or Firm*—Wolf Block Schorr & Solis-Cohen LLP

(57) ABSTRACT

This system is characterized in that it comprises a radio remote control, with transmission protocol, and a modulator-receiver decoding the radio signal and modulating the network voltage to thus transmit the information to the light source being installed inside the spotlight, said modulator-receiver thus controlling the illumination being performed by the diodes (LEDs). This system does as well comprise a transformer being apt to power the light sources with 12 Vac, the modulator-receiver being inserted into the primary winding of said transformer. The light sources rectify and filter the secondary voltage, and by means of two auxiliary diodes they recover the information corresponding to the two half-waves, in such a way that the microcontroller can analyze the half-waves thus detecting those having been trimmed in the primary winding; the transmission protocol decoding the commands and thus allowing the microcontroller to operate the diodes (LEDs) according to the command being received.

7 Claims, 1 Drawing Sheet

SWIMMING POOL SPOTLIGHT LIGHTING SYSTEM

FIELD OF THE INVENTION

The present invention relates to a lighting system for spotlights being intended to be installed inside the swimming pool in order to illuminate the water. This system can also be used for spotlights being installed in fountains, ornamental lakes and different water effects.

BACKGROUND OF THE INVENTION

Conventional spotlights have as their light source one or several bulbs in this latter case requiring a substantial bulk on top of emitting a substantial amount of heat.

SUMMARY OF THE INVENTION

This invention has as its object lighting system whose light-producing elements are made up of light-emitting diodes (LEDs) 1 preferentially being of different colors such as red, blue and green, said diodes being apt to be switched on and off on a random basis and for such a purpose being controlled by means of a radio remote control 2.

A spotlight is thus obtained which has an acceptable size, does not emit heat, and automatically produces an extensive combination of colors.

BRIEF DESCRIPTION OF THE DRAWING

A more complete appreciation of the present invention and many of the attendant advantages thereof will be readily understood by reference to the following detailed description when considered in conjunction with the accompanying drawing, in which.

DETAILED DESCRIPTION OF THE INVENTION

Figure 1:
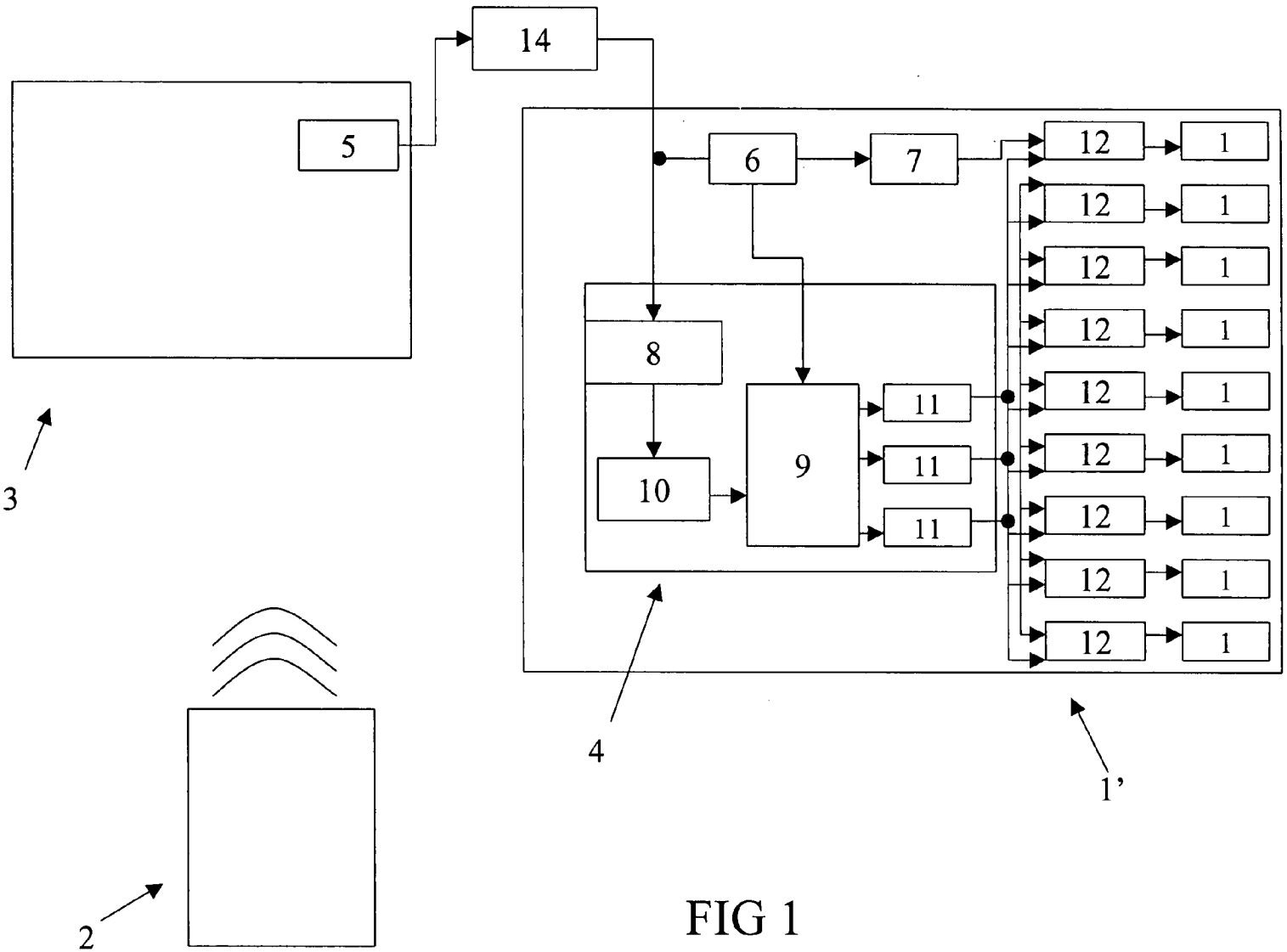
FIG. 1 illustrates a spotlight lighting system according to the present invention.

The system does for such a purpose comprise said radio remote control 2, with transmission protocol, as well as a modulator-receiver 3 being installed in the primary winding of the transformer and receiving the radiotransmitted commands and passing them through the transformer to the light sources being installed inside the spotlight 1', and it also comprises the system control 4.

The LEDs 1 can if desired be all of white color; or else they can be combined with the colored ones.

The radio control 2 is a battery-powered control and can send the following commands: on/off, time-dependent or color mix-dependent color change, fixed color, and time-controlled switching off.

The system comprises a transformer being apt to power one or more light sources with 12 Vac, said light sources being synchronously operated. The modulator-receiver 3 is inserted into the primary winding of the transformer 14 and includes a Triac 5 in order to trim off by a few degrees some given half-waves of the alternating current. The secondary voltage is rectified with a diode bridge 6 and filtered with electrolytic capacitors 7 in order to thus obtain a direct current supply.

The information corresponding to the two half-waves is recovered with two auxiliary diodes 8, in such a way that the microcontroller 9 can by means of an analog-to-digital converter 10 analyze the half-waves thus detecting those having been trimmed in the primary winding. The transmission protocol is operable to transform the bits composing it into a sequence of labeled half-waves, and is thus apt to pass the information being needed for the operation of the LEDs 1.

Each of the colors of the LEDs is controlled with a dedicated circuit consisting in a microcontroller 9 output and a transistor 11 generating a voltage determining the maximum current generated by the power circuits 12.

A pulse-width modulation system allows to regulate the light intensity for each color of the LEDs 1.

The composition of each of the composite colors of the LEDs 1 is determined by three percentages of width-modulated pulses, said percentages being stored in the memory of the microcontroller 9.

The above description allows to appreciate the simplicity of this spotlight, this latter having a reduced consumption and a longer life and allowing to use the already existing facility since it does not require an additional wiring or a wiring other than that being used by a conventional spotlight.

The invention can within its essentiality be put into practice in other embodiments only in detail differing from that having been given only by way of example, said other embodiments also falling within the scope of the protection being sought.

The invention claimed is:

1. A swimming pool spotlight lighting system comprising:

a radio remote control, with transmission protocol; and a modulator-receiver installed in a primary winding of a transformer, wherein said modulator-receiver receives radio transmitted commands transmitted by said remote control and passing said commands to LED light sources installed inside the spotlight;

wherein said commands corresponding to two half-waves is recovered with two auxiliary diodes, in such a way that a microcontroller can analyze the half-waves thus detecting the half-waves that have been trimmed in the primary winding; and wherein the transmission protocol being operable to transform the bits composing said commands into a sequence of labeled half-waves, and thus being apt to transmit commands needed for the operation of LEDs; and wherein said LEDs are operated by said microcontroller based upon said transmitted commands.

2. A swimming pool spotlight lighting system as per claim 1, wherein it comprises the transformer being apt to power the light sources with 12 Vac, the modulator-receiver being inserted into the primary winding of said transformer, the secondary voltage being rectified and filtered in order to thus obtain a direct current supply.

3. A swimming pool spotlight lighting system as per claim 1, wherein the LEDs are white.

4. A swimming pool spotlight lighting system as per claim 1, wherein the LEDs are of different colors.

5. A swimming pool spotlight lighting system as per claim 4, wherein each of the colors of the LEDs is controlled with a dedicated circuit consisting in a microcontroller output and a transistor generating a voltage determining the maximum current being generated by the power circuits.

6. A swimming pool spotlight lighting system as per claim 4, wherein a pulse-width modulation system allows to regulate the light intensity for each color of the LEDs.

7. A swimming pool spotlight lighting system as per claim 4, wherein the composition of each of the composite colors of the LEDs is determined by three percentages of width-modulated pulses, said percentages being stored in the memory of the microcontroller.

* * * * *